US005710415A

United States Patent [19]

Kono et al.

[11] Patent Number: 5,710,415

[45] Date of Patent: Jan. 20, 1998

[54] SALES-REGISTRATION-DATA PROCESSING APPARATUS

[75] Inventors: Mitsunori Kono, Shizuoka-ken; Yukio Tsuchiya, Susono; Kunio Matsushita, Yokosuka, all of Japan

[73] Assignee: Kabushiki Kaisha TEC, Shizuoka, Japan

[21] Appl. No.: 613,002

[22] Filed: Mar. 8, 1996

[30] Foreign Application Priority Data

Mar. 10, 1995 [JP] Japan ..... 7-051614
Mar. 10, 1995 [JP] Japan ..... 7-051615

[51] Int. Cl.[6] ..... G07G 1/00

[52] U.S. Cl. ..... 235/7 R; 235/23

[58] Field of Search ..... 235/7 R, 20, 23

[56] References Cited

U.S. PATENT DOCUMENTS

| | | | |
|---|---|---|---|
| 4,280,034 | 7/1981 | Ezaki et al. | 235/1 |
| 4,645,153 | 2/1987 | Granzow et al. . | |
| 4,790,504 | 12/1988 | Wills et al. | 248/183 |
| 4,803,346 | 2/1989 | Lyons et al. | 235/7 R |
| 5,005,669 | 4/1991 | Umebara et al. . | |
| 5,109,573 | 5/1992 | Sherman . | |
| 5,187,743 | 2/1993 | Gumb et al. . | |
| 5,609,086 | 3/1997 | Addison et al. | 83/440 |

OTHER PUBLICATIONS

IBM Technical Disclosure Bulletin, vol. 22, No. 7, Dec. 1979 New York, U.S.A., pp. 2846–2848, X9002028374, Anonymous: "Display Assembly for Point-of-Sale Terminal. Dec. 1979".

IBM Technical Disclosure Bulletin, vol. 24, No. 1A, Jun. 1981, New York, U.S.A., pp. 186–187, XP002028376, Anonyomous: "Adjustable Tilt Mechanism for Data Entry Terminal. Jun. 1981".

*Primary Examiner*—Michael L. Gellner
*Assistant Examiner*—Daniel Chapik
*Attorney, Agent, or Firm*—Frishauf, Holtz, Goodman, Langer & Chick

[57] ABSTRACT

A sales-registration-data processing apparatus includes a display unit being independent of a control unit housing and having a display portion on an outer surface thereof, and a tilt-angle adjustment and maintaining mechanism rotatably connecting the display unit to the housing, capable of tilting the display unit with respect to the housing and maintaining a desired tilt angle of the display unit. The tilt-angle adjustment and maintaining mechanism includes an erection guide groove formed in the outer surface of the housing and having a substantially circular-arc shaped vertical cross section, a guide projection mounted on a region of the outer surface of the display unit opposite to the display portion and being slidable along the erection guide groove of the housing, and a frictional-force adjustment mechanism mounted on the guide projection to be frictionally engaged with the erection guide groove and capable of adjusting frictional force generated between the frictional-force adjustment mechanism and the erection guide groove.

9 Claims, 10 Drawing Sheets

SALES-REGISTRATION-DATA PROCESSING APPARATUS

BACKGROUND OF THE INVENTION

1. Field of the Invention

The present invention relates to a sales-registration-data processing apparatus, and more particularly to a sales-registration-data processing apparatus having a housing for accommodating a control unit, a display unit being independent of the housing and having a display portion on an outer surface thereof, and a tilt-angle adjustment and maintaining mechanism rotatably connecting the display unit to the housing, capable of tilting the display unit with respect to the housing and maintaining a required tilt angle of the display unit.

2. Description of the Related Art

A sales-registration-data processing apparatus of the above described type has been known as an electronic cash register. In the electronic cash register of this type, a consumer-product code of a consumer product purchased by a consumer is inputted into the control unit by a keyboard provided on the housing or a touch panel displayed on the display portion of the display unit or a bar-code scanner connected to the control unit in the housing and extending from the housing. The control unit searches a consumer-product data (for example, trade name and price) corresponding to the inputted consumer-product code among various consumer-product data previously memorized in a consumer-product file in the control unit, and registers the searched data of the consumer product in a sales file in the control unit. The registered consumer-product data is displayed on the display portion of the display unit. When a totaling command is inputted through the keyboard or the touch panel after the consumer-product codes of all of the consumer products purchased by the consumer have been inputted into the control unit, the control unit calculates a total (a subtotal) of the prices of all of the purchased consumer products, an amount of the sales taxes imposed on the subtotal, and a total (a ground total) of the subtotal and the amount of the sales taxes, and displays the subtotal, the sales tax and the grand total on the display portion of the display unit.

Then, when an operator of the electronic cash register inputs the amount of money delivered from the consumer into the control unit by using the keyboard, the control unit calculates the difference between the grand total and the amount of the delivered money (that is, a change), and displays the amount of the delivered money and the change (if it exist) on the display portion of the display unit. Simultaneously, the control unit makes a receipt issuing machine accommodated in the housing issue a receipt on which required information including results of the above described calculations is printed. Finally, the operator hands the issued receipt and the change (if it exist) to the consumer, and one account operation for the consumer is completed.

In a case where account operations for many consumers must be performed in a short time, for example in a supermarket, the display portion of the display unit must be easy to be seen. Therefore, the display unit is connected to the housing through a tilt-angle adjustment and maintaining mechanism so as to be able to set and maintain a tilt angle at which an operator can see most easily the display portion in accordance with lighting conditions of a spot at which the electronic cash register is located, or a height of the operator of the electronic cash register. The tilt-angle adjustment and maintaining mechanism is considerably required in a case where the display portion of the display unit uses a liquid crystal display (LCD) readable angle of which is narrow.

FIG. 11 shows a tilt-angle adjustment and maintaining mechanism of the conventional electronic cash register. The tilt-angle adjustment and maintaining mechanism 12 is attached to an upper surface of a housing 14 which accommodates a control unit (not shown), and is connected by a rotation-center pin 12*a* to a lower end of a display unit 16, the display unit being independent of the housing 14 and having a display portion on an outer surface thereof. The display unit 16 can be rotatable around the rotation-center pin 12*a* so that the display unit 16 can be titled with respect to the upper surface of the housing 14. Moreover, the tilt-angle adjustment and maintaining mechanism 12 has an angle maintaining member 12*c* one end of which is rotatively connected by a rotation-center pin 12*b* to a region (back- side) of the outer surface of the display unit 16 opposite to the display portion. In addition, the tilt-angle adjustment and maintaining mechanism 12 has an engaging plate 12*d* attached to a region of the upper surface of the housing 14 which faces the back side of the outer surface of the display unit 16 when the display unit 16 is laid on the upper surface of the housing 14 in such a manner that the back side of the display unit 16 faces the upper surface of the housing 14. Many engaging projections 12*e* are formed on an upper surface of the engaging plate 12*d*. Thus, the display unit 16 can be maintained at a desired tilt angle with respect to the upper surface of the housing 14 by engaging another end (a free end) of the angle maintaining member 12*c* with any one of the engaging projections 12*e*, as shown in FIG. 11.

The conventional tilt-angle adjustment and maintaining mechanism as shown in FIG. 11 is effective for the conventional display unit 16 the display portion of which has a small area and is not used frequently so that the display unit 16 is small in size and light in weight. In recent years, however, a requirement to enlarge the area of the display portion of the display unit 16 have been arisen. If a display unit having a larger display portion than the conventional one, that is larger and heavier than the conventional display unit 16 shown in FIG. 11 is used to satisfy the above described requirement, the above described various components of the conventional tilt-angle adjustment and maintaining mechanism shown in FIG. 11 must be enlarged in size as compared with the conventional components in order to stably support the display unit larger and heavier than the conventional display unit. Moreover, great force is required to change the tilt angle of the large and heavy display unit, thus the tilt angle change operation becomes hard. Further, a possibility that an article might be caught by the large sized angle maintaining member 12*c* increases, so that a possibility that the engagement of the angle maintaining member 12*c* with the engaging projections 12*e* of the engaging plate 12*d* is released by the caught article and, therefore, the display unit 16 falls down toward the upper surface of the housing 14, increases thereby increasing a possibility that the display unit 16 and the housing 14 may be damaged. Moreover, the tilt-angle adjustment and maintaining mechanism various components of which become larger and heavier than the conventional ones, together with the display unit size and weight of which become larger and heavier than the conventional ones, project largely from the upper surface of the housing 14. This deteriorates an outer appearance of the electronic cash register, and hampers the movement and transportation of the electronic cash register.

Further, in a case where the electronic cash register is operated in a high humid place or with wet fingers, for example the electronic cash register is used on a lunch counter adjacent to a kitchen in a relatively small restaurant, steam generated in the kitchen or water attached to the wet fingers may be attached on the display portion of the display unit, and then may flow down along the tilted display portion as waterdrops. If the flowed down waterdrops enter into the display unit through gaps between an external housing of the display unit and the display portion, electronic and/or electric parts in the display unit tend to be damaged. And, if the waterdrops enter into the housing 14 through gaps in the upper surface of the housing 14, for example gaps in the keyboard, the control unit in the housing 14 tends to be damaged. The quantity of waterdrops attached to the display portion of the display unit is increased with increasing of the area of the display portion.

SUMMARY OF THE INVENTION

This invention is derived from the above described circumstances, and an object of the present invention is to provide a sales-registration-data processing apparatus which can adjust easily a tilt angle of a display unit thereof and maintain safely a desired tilt angle of the display unit even if the size and weight of the display unit is increased in comparison with those of the conventional one, and which can eliminate the projection the display unit and a tilt-angle adjustment and maintaining mechanism from the outer surface of the housing when the display unit the size and weight of which is increased in comparison with those of the conventional ones is laid down to place the display portion along the outer surface of the housing, and thus not deteriorate the outer appearance thereof, and which can be moved and transported easily.

In order to achieve the above described object, a sales-registration-data processing apparatus according to this invention comprises: a housing for accommodating a control unit; a display unit being independent of the housing and having a display portion on an outer surface thereof; and a tilt-angle adjustment and maintaining mechanism rotatably connecting the display unit to the housing, capable of tilting the display unit with respect to the housing and maintaining a desired tilt angle of the display unit, wherein the tilt-angle adjustment and maintaining mechanism includes an erection guide groove formed in the outer surface of the housing and having a substantially circular-arc shaped vertical cross section, a guide projection mounted on a region of the outer surface of the display unit opposite to the display portion and being slidable along the erection guide groove of the housing, and a frictional-force adjustment mechanism mounted on the guide projection to be frictionally engaged with the erection guide groove and capable of adjusting frictional force generated between the frictional-force adjustment mechanism and the erection guide groove.

The tilt-angle adjustment and maintaining mechanism having the above described structure eliminates to project the display unit and the tilt-angle adjustment and maintaining mechanism from the outer surface of the housing when the display unit is laid down to place the display portion along the outer surface of the housing, so that the outer appearance of the sales-registration-data processing apparatus can not be deteriorated. The frictional-force adjustment mechanism makes frictional force which generates between the erection guide groove of the housing and the guide projection being adjustable so that the tilt angle of the display unit can be adjusted easily and a desired tilt angle of the display unit is maintained reliably in accordance with the weight of the display unit.

In the above described sales-registration-data processing apparatus according to the present invention, it is preferable that the frictional-force adjustment mechanism has an elastic member which is in contact with a periphery of the erection guide groove in an inside of the housing, and a contact-pressure adjustment member connecting the elastic member to the guide projection, the contact-pressure adjustment member being capable of adjusting contact pressure of the elastic member with respect to the periphery of the erection guide groove. The above described preferred frictional-force adjustment mechanism has a simple structure and makes a frictional force adjustment operation being easy.

Moreover, it is preferable that the foregoing sales-registration-data processing apparatus according to the present invention further comprises a reaction generating mechanism interposed between the outer surface of the display unit and the outer surface of the housing, and maintaining a predetermined tilt angle of the display unit with respect to the housing against external force acting on the display unit in a direction in which the predetermined tilt angle is reduced while the display unit is maintained at the predetermined tilt angle.

The reaction generating mechanism as described above can maintain the tilt angle of the display unit more reliably.

The reaction generating mechanism may includes an external-force supporting member rotatably mounted on the outer surface of the display unit and having a plurality of engagement portions; and an engaged portion mounted on the outer surface of the housing and being engaged with any one of the engagement portions of the external-force supporting member in accordance with a rotational angle of the external-force supporting member with respect to the outer surface of the display unit.

The reaction generating mechanism having the above described structure has a simple structure and exhibits a reliable function.

It is preferable that the reaction generating mechanism having the above described structure further includes an urging member which urges the external-force supporting member to move the plural engagement portions toward the engaged portion on the outer surface of the housing.

Since the urging member enables any one of the plural engagement portions of the external-force supporting member to be automatically engaged with the engaged portion on the outer surface of the housing at a plurality of predetermined angles when the tilt angle of the display unit is increased, and a predetermined tilt angle setting operation to the display unit can be performed rapidly and easily. Moreover, the display unit can be maintained at a plurality of predetermined tilt angles more stably.

When the sales-registration-data processing apparatus according to the present invention uses the reaction generating mechanism, the external-force supporting member of the reaction generating mechanism is rotatably mounted on the region of the outer surface of the display unit opposite to the display portion. Further, it is preferable that a space for accommodating the external-force supporting member is formed between the region of the outer surface of the display unit opposite to the display portion and a region of the outer surface of the housing corresponding to the opposite region of the display unit when the display unit is so arranged that the display portion is placed along the outer surface of the housing with the external-force supporting member being arranged along a region on the outer surface of the display unit opposite to the display portion.

The reaction generating mechanism as described above does not project from the outer surface of the housing, does not deteriorate the outer appearance of the sales-registration-data processing apparatus according to the present invention, and does not hamper the movement and transportation of the sales-registration-data processing apparatus according to the present invention.

It is preferable that the sales-registration-data processing apparatus structured as described above and according to the present invention has a recess mounted on the outer surface of the housing to be independent of the erection guide groove, along a rotational center line of the display unit and adjacent to the erection guide groove of the tilt-angle adjustment and maintaining mechanism, whereby waterdrops attached to the outer surface of the display unit and flowing down along the tilted outer surface of the display unit during the display unit is tilted with respect to the outer surface of the housing, is collected in the recess.

With the above described structure, if the sales-registration-data processing apparatus according to the present invention is operated in a humid place or with wet fingers, for example the sales-registration-data processing apparatus according to the present invention is used on a lunch counter adjacent to a kitchen in a relatively small restaurant, and steam generated in the kitchen or water attached to the wet fingers is attached on the display portion of the display unit and then may flow down along the tilted display portion as waterdrops, the waterdrops can be prevented effectively from entering into the display unit and the housing with such a simple structure as described above. Thus, damage to electronic or electric parts in the display unit and failure of the control unit in the housing due to entering of the waterdrops therein can be prevented effectively.

The above described recess may have a waterdrop discharge mechanism which discharges waterdrops collected in the recess to the outside of the housing. The waterdrop discharge mechanism is significantly effective when the sales-registration-data processing apparatus according to the present invention is operated in a very high humid place or in a relatively small restaurant in which a quantity of steam generated in a kitchen is very large or is frequently operated with wet fingers.

The sales-registration-data processing apparatus according to the present invention may comprise: a housing for accommodating a control unit; a display unit being independent of the housing and having a display portion on an outer surface thereof; and a tilt-angle adjustment and maintaining mechanism for rotatably connecting the display unit to the housing, capable of tilting the display unit with respect to the housing and maintaining a required tilt angle of the display unit, wherein a recess is mounted on the outer surface of the housing to accommodate the tilt-angle adjustment and maintaining mechanism; and the recess is provided with a water collecting recess which collects waterdrops attached to the outer surface of the display unit and flowing down along the tilted outer surface of the display unit during the display unit is tilted with respect to the outer surface of the housing.

As a result of this structure, if the size of the display unit is enlarged as compared with the conventional one, the tilt-angle adjustment and maintaining mechanism does not project from the outer surface of the housing. Therefore, the outer appearance of the apparatus does not be deteriorated and the apparatus can be moved and transported easily. Moreover, even with such a simple structure, entering of waterdrops into the display unit and the housing can be prevented effectively. Thus, damage to electronic or electric parts in the display unit and failure of the control units in the housing due to entering of the waterdrops can be prevented effectively.

In order to use the sales-registration-data processing apparatus according to the present invention in a very high humid place or in a place in which a quantity of steam is very large or with wet fingers frequently, the water collecting recess may have a waterdrop discharge mechanism which discharges waterdrops collected in the water collecting recess to the outside of the housing.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

A sales-registration-data processing apparatus according to an embodiment of the present invention and a modification thereof will now be described in detail with reference to FIGS. 1 to 10.

Figure 1:
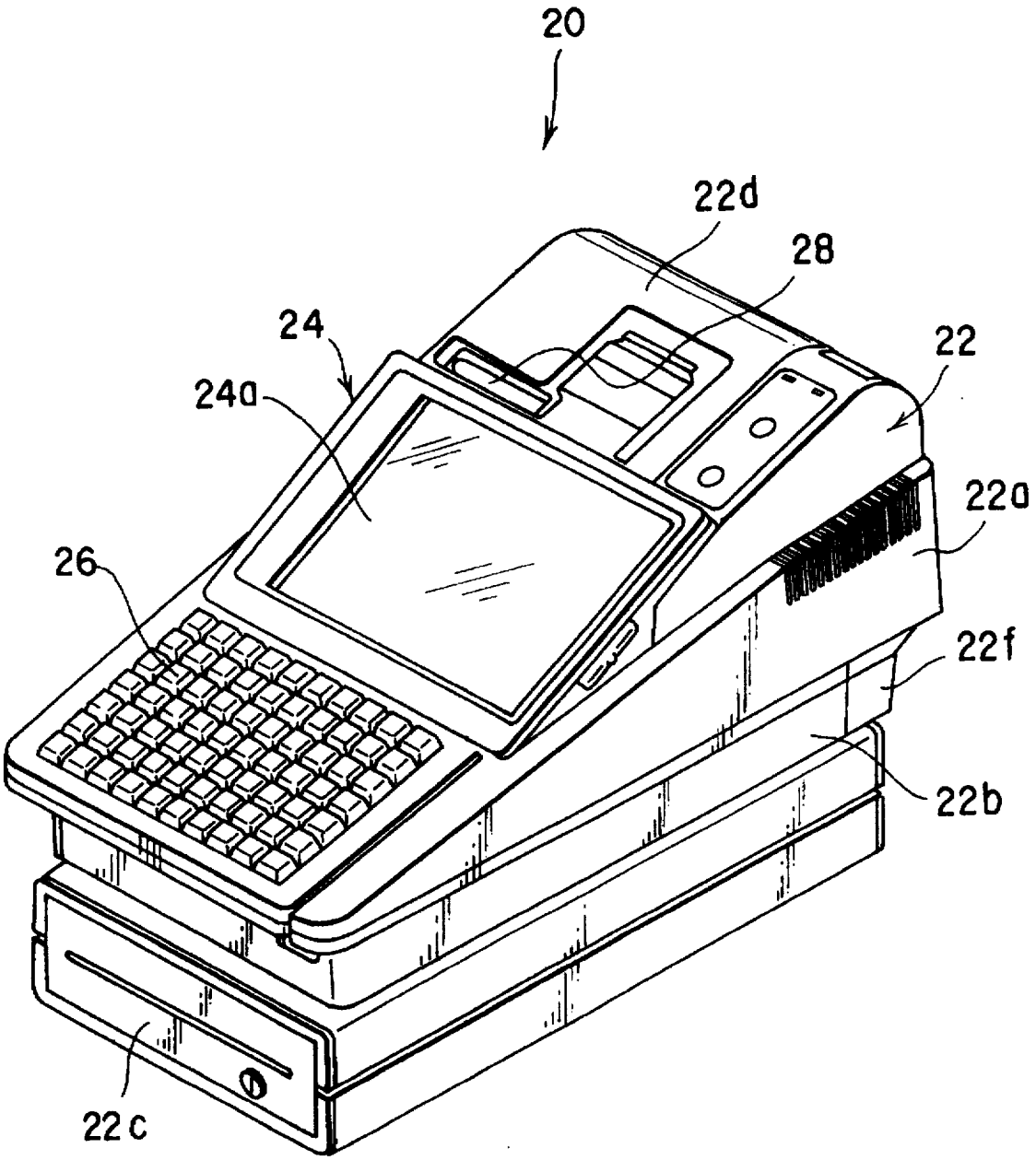
FIG. 1 is a perspective view showing a sales-registration-data processing apparatus according to an embodiment of the present invention.

The sales-registration-data processing apparatus according to the embodiment of the present invention is an electronic cash register. FIG. 1 shows an outer appearance of the electronic cash register.

Referring to FIG. 1, the electronic cash register is designated by reference numeral 20, a housing 22 of the electronic cash register 20 is composed of upper and lower cases 22*a* and 22*b* which can be vertically separated from each other. A drawer 22*c* is attached to a lower surface of the lower case 22*b*.

An upper surface of the upper case 22*a* is inclined to gradually increase its height in a direction from a front edge thereof at which the drawer 22*c* is opened, toward a rear end thereof to which the drawer 22*c* is moved when it is closed. A display unit 24 having a display portion 24*a*, for example on an upper surface thereof, is disposed in a central portion of the upper surface of the upper case 22*a*. A keyboard 26 is arranged on the upper surface of the upper case 22*a* at a position in front of the display unit 24. A receipt discharge opening 28 is opened in the upper surface of the upper case 22*a* at position located in the back of the display unit 24.

A region of the top surface of the upper case 22*a* located in the back of the display unit 24 is composed of a detachable receipt cover 22*d* in which the receipt discharge opening 28 is formed. By removing the receipt cover 22*d* from the remaining portion of the upper case 22*a* as shown in FIG. 2, mounting of a receipt sheet (not shown), and inspection of a variety of control units accommodated in the housing 22 can be performed from a position located above the electronic cash register 20.

Figure 2:
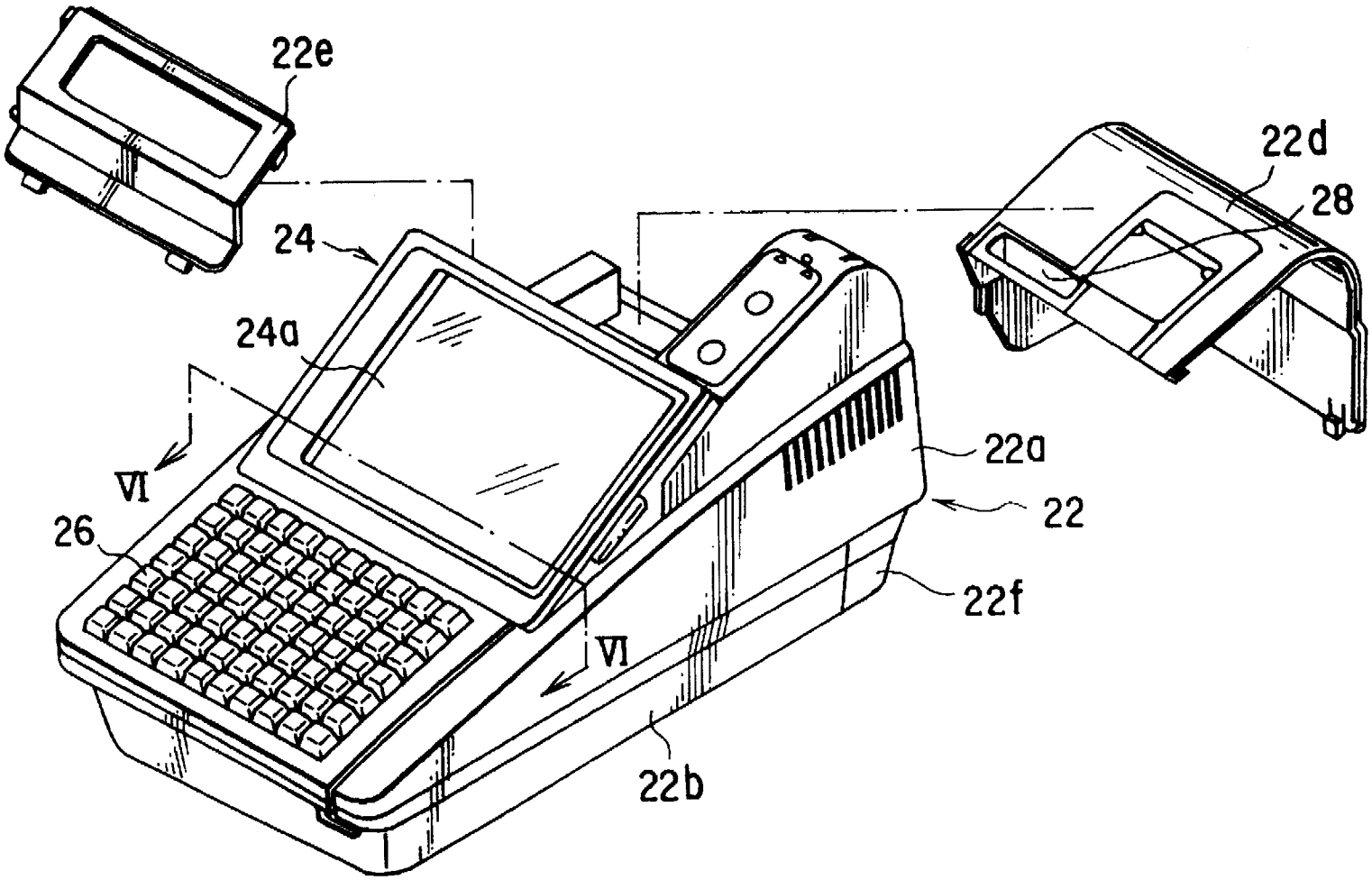
FIG. 2 is a partially exploded perspective view of a housing of the sales-registration-data processing apparatus shown in FIG. 1.

Also, a region of the upper surface of the upper case 22*a* corresponding to a substantially rear half portion of a back surface (a surface opposite to the display portion 24*a*) of the display unit 24 and being adjacent to the receipt cover 22*d* is, as shown in FIG. 2, composed of a detachable upper inspection cover 22*e*. By removing the upper inspection cover 22*e* from the remaining portion of the upper case 22*a* as shown in FIG. 2, inspection of the variety of the control units accommodated in the housing 22 can be performed from a position located in front of and above the receipt cover 22*d*.

Further, a rear end portion of the lower case 22*b* is composed of a detachable rear inspection cover 22*f*. By removing the rear inspection cover 22*f* from the remaining portion of the lower case 22*b*, inspection of the variety of the control units accommodated in the housing 22 can be performed from a position located in the back of the lower case 22*b*.

The display unit 24 is rotatively connected to the central portion of the upper surface of the upper case 22*a* through a tilt-angle adjustment and maintaining mechanism (to be described later) so that the display unit 24 can be rotated in a predetermined angular range. Thus, the display unit 24 can be tilted with respect to the upper surface of the upper case 22*a* within a predetermined angular range and can be maintained at a desired tilt angle due to the tilt-angle adjustment and maintaining mechanism to be described later.

In this embodiment, the display portion 24*a* is composed of a liquid crystal display device (LCD).

Figure 3:
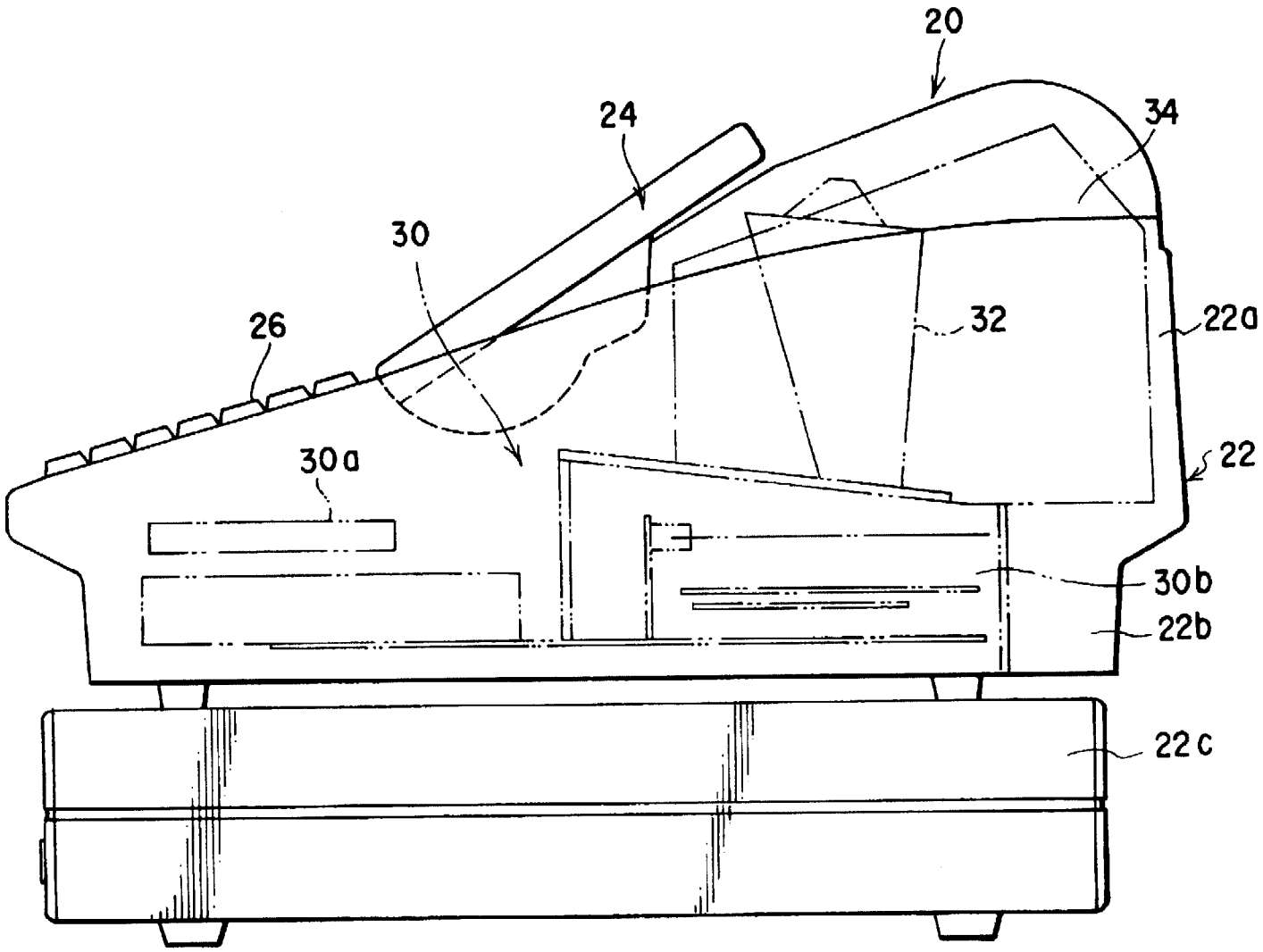
FIG. 3 is a side view of the sales-registration-data processing apparatus shown in FIG. 1, an internal structure thereof being illustrated by a hidden outline.

FIG. 3 schematically shows the variety of the control units 30 accommodated in the housing 22. The various control units 30 include, for example a memory unit 30*a*, such as a hard disk, and a control board 30*b* structured by using a variety of electronic parts. Moreover, the housing 22 accommodates a receipt printing unit 32 and a variety of electric units 34 including a power-source unit for the various control units 30 and the receipt printing unit 32. Structures and functions of the various control units 30, the receipt printing unit 32 and the various electric units 34 are the same as those of a conventional electronic cash register, and are well known. Therefore, the structures and the functions of the various control units 30, receipt printing unit 32 and the various electric units 34 are not disclosed, and these have no relation to the subject matter of the present invention.

Figure 4:
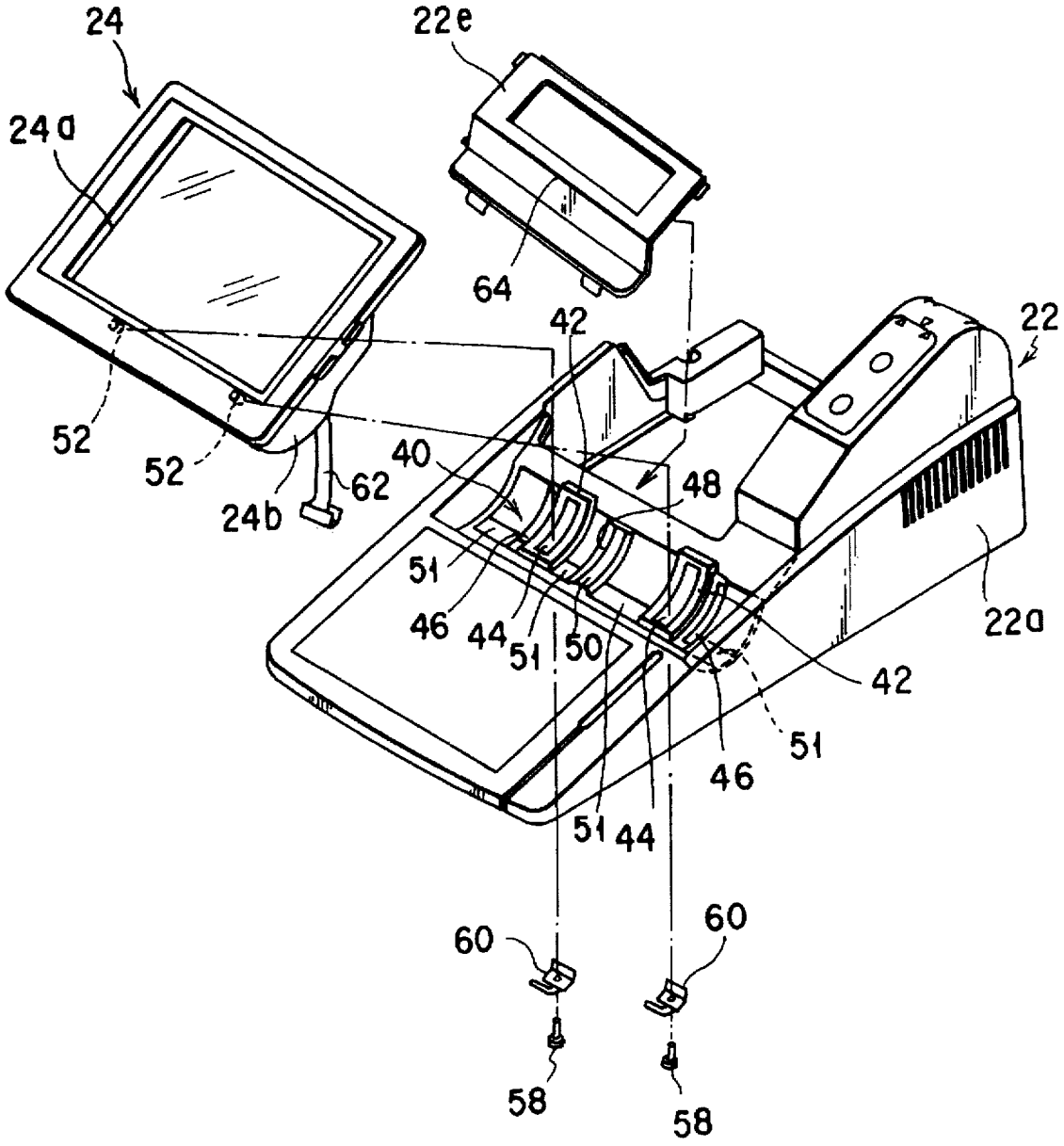
FIG. 4 is a perspective view showing the housing of the sales data processing apparatus shown in FIG. 1 and a display unit thereof separated from the housing.
Figure 5:
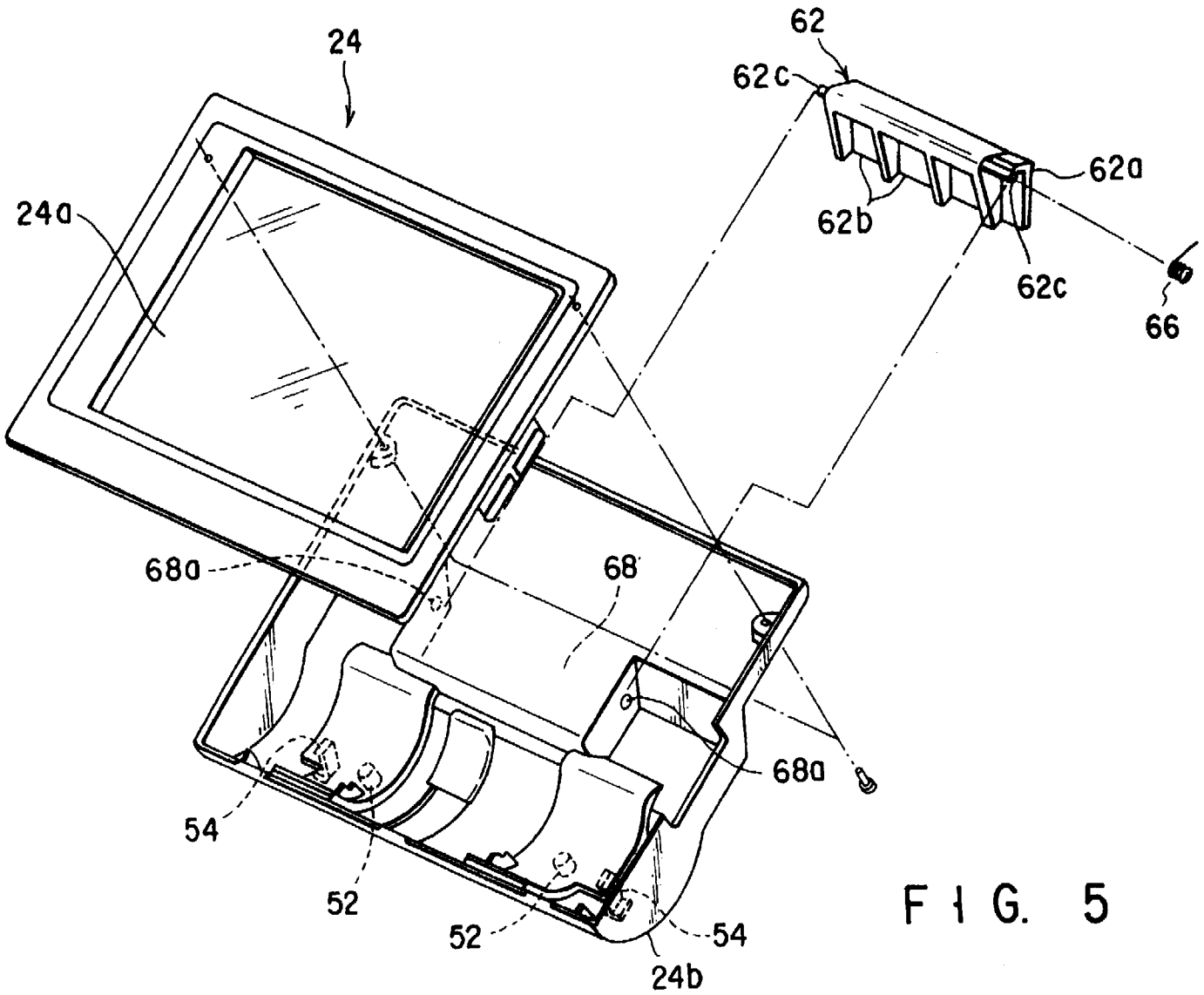
FIG. 5 is an exploded perspective view of the display unit of the sales-registration-data processing apparatus shown in FIG. 1.
Figure 6:
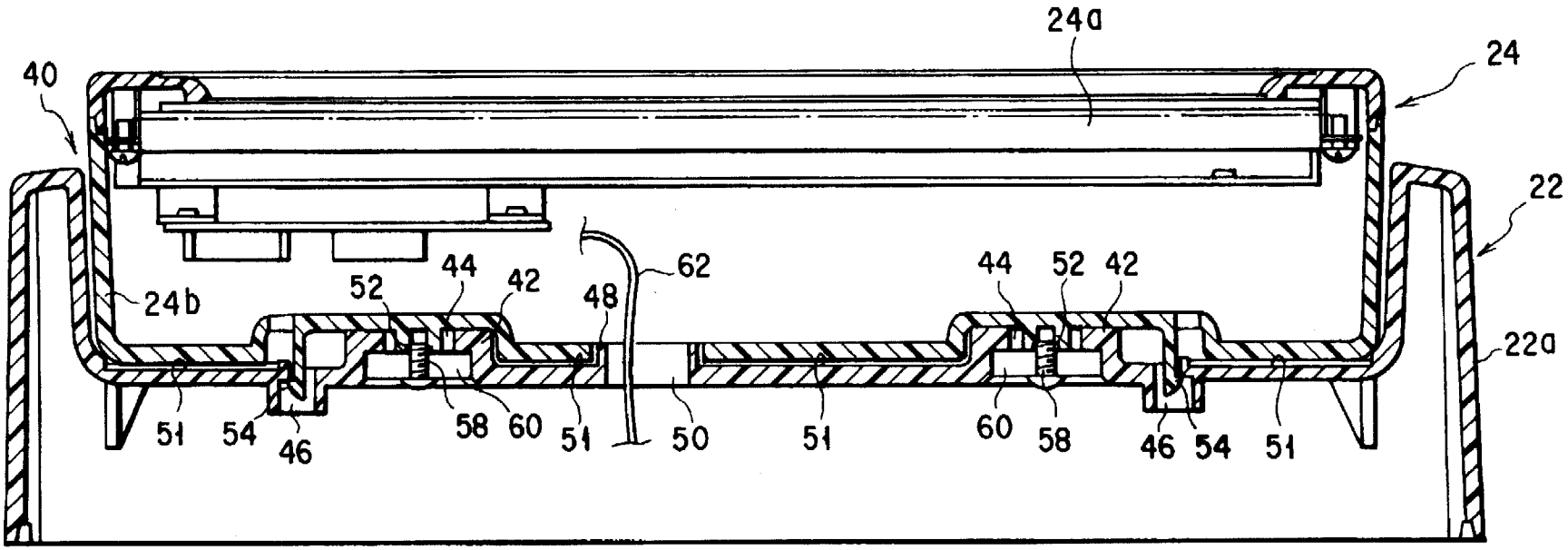
FIG. 6 is a cross sectional view showing a structure of a tilt-angle adjustment and maintaining mechanism which connects the housing and the display unit of the sales-registration-data processing apparatus shown in FIG. 1 to each other, and taken along a line VI—VI shown in FIG. 2.

Referring to FIGS. 4, 5 and 6, the tilt-angle adjustment and maintaining mechanism structured characteristically by the present invention, will now be described.

In a region of the upper surface of the upper case 22*a* and corresponding to a substantially forward half portion of the back surface (a surface opposite to the display portion 24*a*) of the display unit 24 and being adjacent to the upper inspection cover 22*e*, a recess 40 having a substantially semicircular cross section is formed. On the bottom surface of the recess 40, a pair of circular-arc shaped rise-up portions 42 are formed at two positions separated from each other in the longitudinal direction of the recess 40, and each of the circular-arc shaped rise-up portions 42 extends in a circular direction of the recess 40. A pair of erection guide grooves 44 having a circular-arc shaped longitudinal cross section are formed in upper surfaces of the pair of the circular-arc shaped rise-up portions 42 and extend in a circular direction of the circular-arc shaped rise-up portions 42.

In the bottom surface of the recess 40, a pair of slidable engagement grooves 46 are formed at outsides of the pair of the circular-arc shaped rise-up portions 42. The slidable engagement grooves 46 extend in the circular direction of the pair of the circular-arc shaped rise-up portions 42, and each of them has a circular-arc shaped longitudinal cross section. Moreover, on the bottom surface of the recess 40, another circular-arc shaped rise-up portion 48 is formed between the pair of the circular-arc shaped rise-up portions 42, and extends in the circular direction of the recess 40. An electric-cable introducing groove 50 is formed in the upper surface of the circular-arc shaped rise-up portion 48, and extends in a circular direction of the rise-up portion 48 so that the groove 50 has a circular-arc shaped longitudinal cross section.

In the lowest position of the bottom surface of the recess 40, waterdrop collecting recesses 51 are formed independent of the pair of the circular-arc shaped rise-up portions 42, the pair of the slidable engagement grooves 46 and the circular-arc shaped rise-up portion 48, the waterdrop collecting recesses 51 being lowered than the bottom surface of the recess 40 and extending in the longitudinal direction of the recess 40.

A substantially front half portion of the back surface of the display unit 24 (the surface opposite to the display portion 24*a*) forms an expanding portion 24*b* having a substantially semicircular cross section to be inserted into the recess 40 in the central portion of the upper surface of the upper case 22*a* so as to be slidable in the recess 40 in the circular direction of the recess 40. On an outer surface of the expanding portion 24*b*, a pair of guide projections 52 and a pair of engagement projections 54 are formed for being inserted into the pair of the erection guide grooves 44 and the pair of the slidable engagement grooves 46 formed in the recess 40 of the upper surface of the upper case 22*a*.

When the expanding portion 24*b* of the back surface of the display unit 24 is slid in the recess 40 of the upper surface of the upper case 22*a* in the circumferential direction of the recess 40 as described above, the pair of the guide projections 52 and the pair of the engagement projections 54 of the display unit 24 are moved in the pair of the erection guide grooves 44 and the pair of the slidable engagement grooves 46 in the extending direction of these grooves.

The projecting ends of the pair of the engagement projections 54 are engaged with inner edges of the pair of the slidable engagement grooves 46, as shown clearly in FIG. 6, so that removing of the expanding portion **24*b* of the back surface of the display unit 24 from the recess 40 of the upper surface of the upper case 22*a*, that is, separation of the display unit 24 from the outer surface of the housing 22, is prevented, and also movement of the expanding portion 24*b* in the recess 40 in the longitudinal direction of the recess 40, that is, movement of the display unit 24 with respect to the outer surface of the housing 22 in a widthwise direction of the housing 22**, is prevented.

Elastic members 60 located at positions inner than the inner edges of the pair of the erection guide grooves 44, are attached to projecting ends of the pair of the guide projections 52 by screws 58, and two ends of each of the elastic members 60 are in contact with both side edges of the corresponding one of the erection guide grooves 44 extending in the longitudinal direction of the erection guide grooves 44. Therefore, when the screws 58 are rotated in one or another direction, the contact pressure of the elastic members 60 against the pair of the erection guide grooves 44 can be adjusted. That is, in this embodiment the screws 58 serve as contact pressure adjustment members according to the present invention, and combinations of the screws 58 and the elastic members 60 serve as a frictional-force adjustment mechanism which is capable of adjusting the frictional force generated between the pair of the erection guide grooves 44 and the pair of the elastic members 60. In this embodiment, the elastic members 60 are composed of leaf springs.

The frictional force can be adjusted easily by removing the upper inspection cover **22*e* adjacent to the recess 40 in the upper surface of the upper case 22*a* during the display unit 24 is tilted at the most erected position with respect to the upper surface of the upper case 22*a*, and then by rotating the screws 58 with a screw driver inserted in an upper inspection opening formed after the upper inspection cover 22*e*** is removed.

Therefore, in this embodiment, the pair of the erection guide grooves 44, the pair of the guide projections 52 and the frictional-force adjustment mechanism (the combination of the screws 58 and the elastic members 60 in this embodiment) form a tilt-angle adjustment and maintaining mechanism rotatively connecting the display unit 24 to the housing 22, capable of tilting the display unit 24 with respect to the housing 22 and maintaining a desired tilt angle of the display unit 24 from the housing 22.

Into the electric-cable introducing groove 50 of the recess 40, electric cables 62 for the display unit 24 is inserted to be connected to the various control units 30 and the various electric units 34 in the housing 22, as shown in detail in FIG. 6.

In the electronic cash register 20 according to this embodiment of the present invention, a reaction generating mechanism is interposed between the outer surface of the display unit 24 and the outer surface of the housing 22. The reaction generating mechanism maintains a predetermined tilt angle of the display unit 24 with respect to the housing 22 against an external force acting on the display unit 24 in a direction in which the predetermined tilt angle is reduced while the display unit 24 is maintained at the predetermined angle.

The reaction generating mechanism, as shown in detail in FIG. 5, includes an external-force supporting member 62 rotatably mounted on the outer surface (on the back surface in this embodiment) of the display unit 24 and having a plurality of engagement portions **62*a* and 62*b*, and an engaged portion 64 mounted, as clearly shown in FIG. 5, on the outer surface of the housing 22 (the upper inspection cover 22*e* of the central portion of the upper surface of the housing 22 in this embodiment) and being engaged with any one of the engagement portions 62*a* and 62*b* of the external-force supporting member 62 in accordance with a rotational angle of the display unit 24 with respect to the outer surface of the housing 22**.

A region of the upper inspection cover **22*e* of this embodiment located adjacent to the recess 40 of the upper surface of the housing 22 forms a step lower than a region in the back of the lower step, and the front edge of the back side region forms the engaged portion 64**.

Moreover, the reaction generating mechanism further includes an urging member 66 which urges the external-force supporting member 62 to move the plural engagement portions **62*a* and 62*b* toward the engaged portion 64 on the outer surface of the housing 22, as shown in detail in FIG. 5**.

Specifically, in the reaction generating mechanism, a pair of rotational center shafts **62*c* are projected from both ends of the external-force supporting member 62 in the widthwise direction of the display unit 24 at positions separated from the plural engagement portions 62*a* and 62*b*. The pair of the rotational center shafts 62*c* of the external-force supporting member 62 are rotatably inserted into a pair of rotational center holes 68*a* formed at both ends in the widthwise direction of the display unit 24 in an internal surface of a recess 68 formed in the back surface of the display unit 24 at a region adjacent to and in the back of the center portion of the expanding portion 24*b*. Moreover, a torsion coil spring wound around one of the pair of the rotational center shafts 62*c* and having both ends engaged with the external-force supporting member 62 and the bottom surface of the recess 68, forms the urging member 66**.

The external-force supporting member 62 is folded to be laid along the back surface of the display unit 24 against the urging force of the urging member 66 when the display unit 24 is disposed to arrange the display portion **24*a* along the upper surface of the housing 22, so that the supporting member 62 is accommodated in the space formed by the lower step of the upper inspection cover 22*e* of the housing 22 on the upper surface of the housing 22. As a result of this, the folded external-force supporting member 62 does not project from the upper surface of the housing 22, so that it does not deteriorate the outer appearance of the electronic cash register 20 according to this embodiment and does not hamper the movement and transportation of the electronic cash register 20**.

Figure 7:
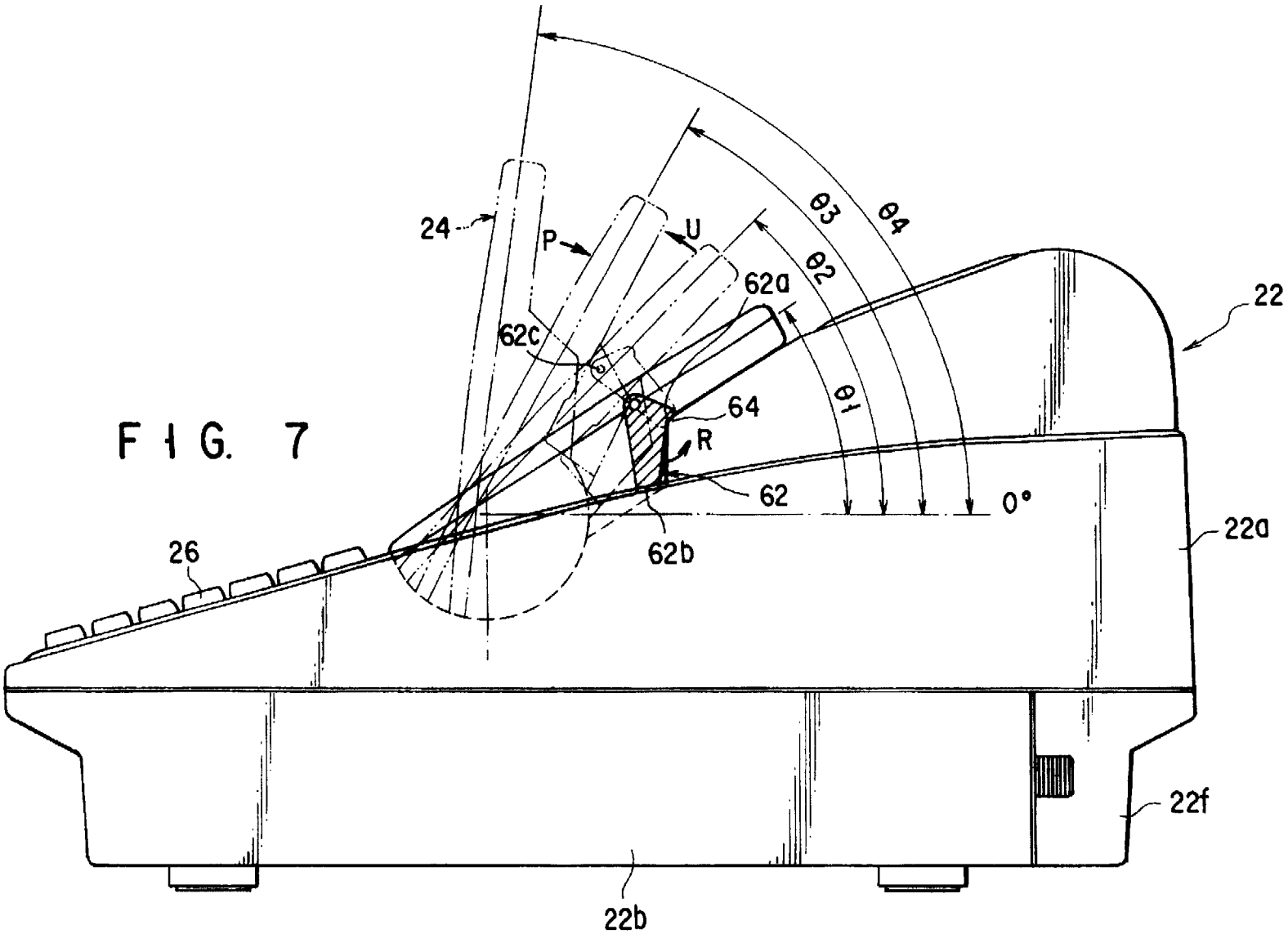
FIG. 7 is a side view showing a state where a reaction generating mechanism of the tilt-angle adjustment and maintaining mechanism of the sales-registration-data processing apparatus shown in FIG. 1 maintains the display unit at a first predetermined tilt angle.
Figure 8:
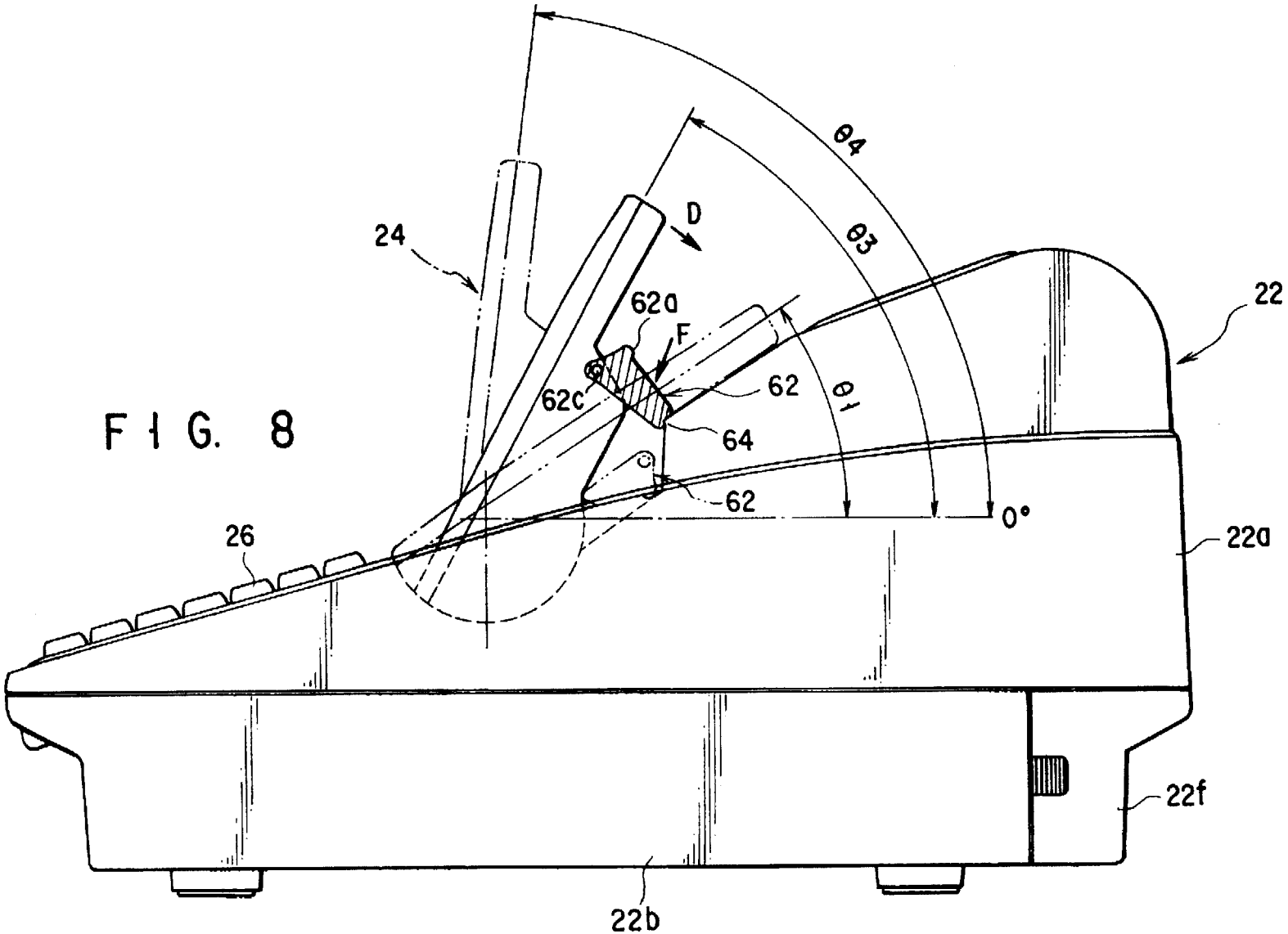
FIG. 8 is a side view showing a state where the reaction generating mechanism of the tilt-angle adjustment and maintaining mechanism of the sales-registration-data processing apparatus shown in FIG. 1 maintains the display unit at a second predetermined tilt angle.

FIGS. 7 and 8 show that the reaction generating mechanism acts when the display unit 24 is set to a first tilt angle and a second tilt angle, respectively. In FIGS. 7 and 8, angle θ1 is an initial tilt angle from the horizontal plane when the display unit 24 is set to arrange the display portion **24*a* along the upper surface of the housing 22. Angle θ2 is a first tilt angle at which the display unit 24 is initially maintained at a first predetermined tilt angle by the reaction generating mechanism against external force. Angle θ3 is a second tilt angle at which the display unit 24 is maintained at a second predetermined tilt angle by the reaction generating mechanism against external force. Angle θ4 is a maximum tilt angle when the display unit 24** is set at a maximum erected position.

As shown in FIG. 7, when the display unit 24 is erected from the initial tilt angle θ1 to be separated from the upper surface of the housing 22 as indicated by an arrow U and the display unit 24 reaches at the first tilt angle θ2, the first engagement portion 62*a* of the external-force supporting member 62 urged by the urging member 66 toward outside as indicated by an arrow R is automatically engaged with the engaged portion 64 on the outer surface of the housing 22. In this situation, even if the display unit 24 is pressed toward the position of the initial tilt angle θ1, as indicated by an arrow P, the external-force supporting member 62 the first engagement member 62*a* of which is engaged with the engaged portion 64 on the outer surface of the housing 22, maintains the display unit 24 at the first tilt angle θ2 against the pressing force.

When the display unit 24 is further erected, as indicated by an arrow U, from the position of the first tilt angle θ2 shown in FIG. 7 and reaches at the second tilt angle θ3, the second engagement portion 62*b* of the external-force supporting member 62 urged toward the outside by the urging member 66 is automatically engaged with the engaged portion 64 on the outer surface of the housing 22, as shown in FIG. 8. In this situation, even if the display unit 24 is pressed toward the position of the initial tilt angle θ1 as indicated by an arrow D, the external-force supporting member 62 the second engagement member 62*b* of which is engaged with the engaged portion 64 on the outer surface of the housing 22, maintains the display unit 24 at the second tilt angle θ3 against the pressing force.

In order to rotate the display unit 24 from the position of the second tilt angle θ3 as shown in FIG. 8 toward the position of the initial tilt angle θ1, the external-force supporting member 62 is depressed against the urging force of the urging member 66 in a direction in which the external-force supporting member 62 approaches the back surface of the display unit 24 as indicated by an arrow F to disengage the second engagement portion 62*b* from the engaged portion 64 on the outer surface of the housing 22, and, then, the display unit 24 is pressed as indicated by the arrow D.

Rotation of the display unit 24 from the position of the first tilt angle θ2 as shown in FIG. 7 to the position of the initial tilt angle θ1 can be performed in the same manner as described above. That is, the external-force supporting member 62 is pressed at first against the urging force of the urging member 66 in the direction in which the external-force supporting member 62 approaches the back surface of the display unit 24 to disengage the first engagement portion 62*a* from the engaged portion 64 on the outer surface of the housing 22. Then, the display unit 24 is pressed as indicated by the arrow P.

FIG. 8 shows that the external-force supporting member 62 is accommodated in the space created by the lower step of the upper inspection cover 22*e* forming the engaged portion 64 of the housing 22, during the display unit 24 is set at the position of the initial tilt angle θ1, so that the external-force supporting member 62 does not project from the upper surface of the housing 22.

With the reaction generating mechanism, any one of the plural engagement portions 62*a* or 62*b* of the external-force supporting member 62 can be automatically engaged with the engaged portion 64 on the outer surface of the housing 22 at the predetermined first tilt angle θ2 or the predetermined second tilt angle θ3 due to the urging member 66 when the tilt angle of the display unit 24 is increased from the initial tilt angle. Therefore, the operation of setting the display unit 24 to the first predetermined tilt angle θ2 and the second predetermined tilt angle θ3 can be completed rapidly and easily. Moreover, the display unit 24 can be maintained further stably at the first predetermined tilt angle θ2 and the second predetermined tilt angle θ3.

In a case where the electronic cash register 20 according to this embodiment is used in a high humid place or operated with wet fingers, for example in a case where the electronic cash register 20 is used on a lunch counter adjacent to a kitchen in a relatively small restaurant, steam generated in the kitchen or water attached to the wet fingers may be attached to the display portion 24*a* of the display unit 24, and then may flow down along the tilted display portion 24. However, the waterdrops 70 (see FIG. 9) are collected in the waterdrop collecting recesses 51 of the recess 40 in the upper surface of the housing 22. The waterdrops collected in the waterdrop collecting recesses 51 are evaporated due to heat generated by the various parts in the housing 22. Therefore, entering of waterdrops into the display unit 24 and the housing 22 can be prevented effectively. As a result of this, damage to the electronic and electric parts in the display unit 24 and failure of the various units in the housing 22 can be prevented effectively.

Although the plural waterdrop collecting recesses 51 are formed in the recess 40 of the housing 22 of the electronic cash register 20 according to the above described embodiment, one continuous waterdrop collecting recess formed by connecting the plural waterdrop collecting recesses 51 each other with communication recesses extending around the pair of the circular-arc shaped rise-up portions 42, the pair of the slidable engagement grooves 46 and the circular-arc shaped rise-up portion 48, may be used.

Figure 10:
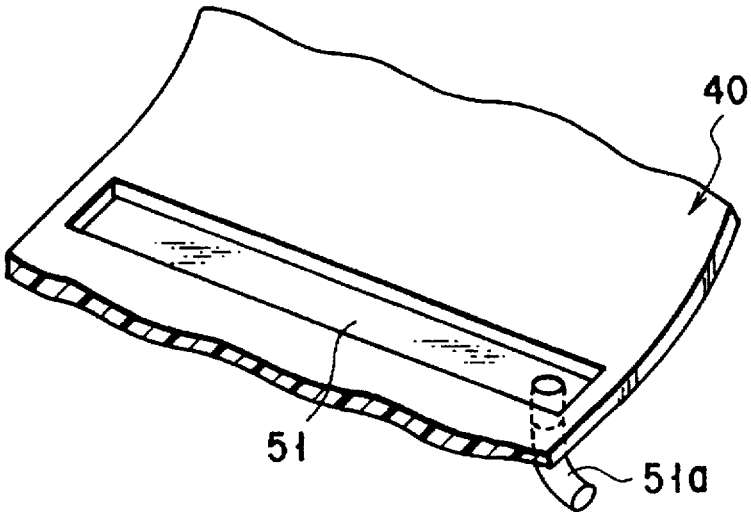
FIG. 10 is an enlarged view showing a waterdrop collecting recess mounted on the outer surface of the housing of the sales-registration-data processing apparatus shown in FIG. 1 to be located adjacent to the tilt-angle adjustment and maintaining mechanism.
Figure 11:
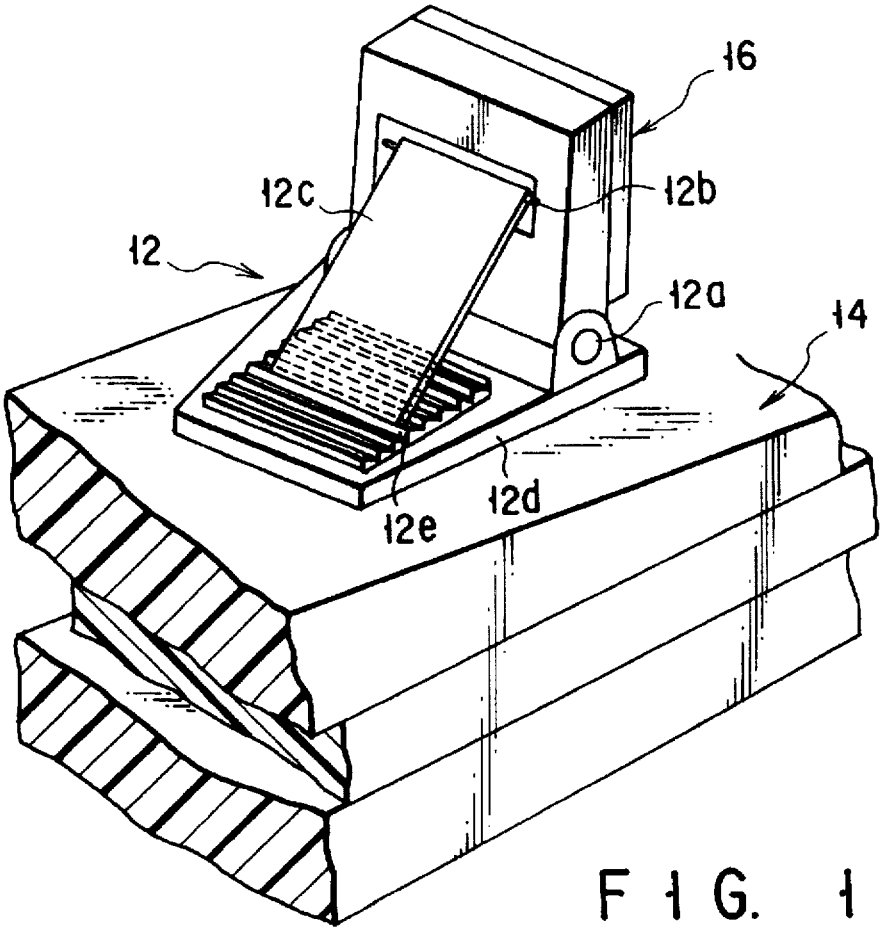
FIG. 11 PRIOR ART
FIG. 11 is a perspective view showing a main portion of a conventional sales-registration-data processing apparatus.

Further, if the electronic cash register 20 according to the above described embodiment is used in a very high humid place or in a relatively small restaurant where the quantity of steam generated in a kitchen is very large or if the electronic cash register 20 is used frequently with wet fingers, the waterdrop collecting recesses 51 may have a waterdrop discharge mechanism 51*a* which discharges waterdrops collected in the waterdrop collecting recesses 51 to the outside of the housing 22 as shown in FIG. 10. The waterdrop discharge mechanism 51*a* shown in FIG. 10 comprises a drain pipe communicating the bottom surface of the waterdrop collecting recesses 51 and a portion of the outer surface of the housing 22 that is lower than the bottom surface of the waterdrop collecting recesses 51.

As an alternative to this, a heating mechanism may be provided in or near around the waterdrop collecting recesses 51 to evaporate waterdrops collected in the waterdrop collecting recesses 51.

Figure 9:
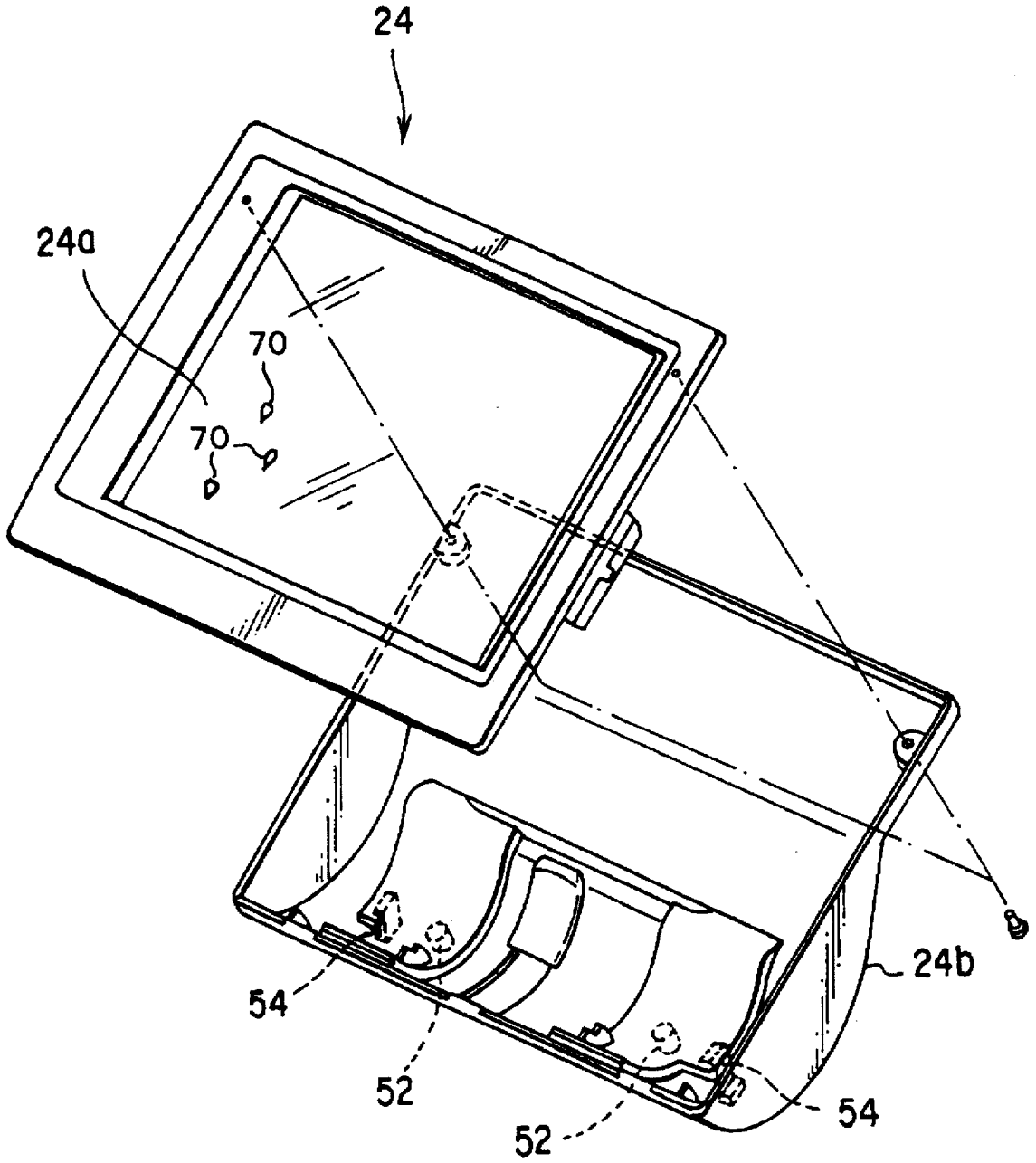
FIG. 9 is an exploded perspective view showing a modification of the display unit of the sales-registration-data processing apparatus shown in FIG. 1.

Although the reaction generating mechanism is disposed between the outer surface of the display unit 24 and the outer surface of the housing 22 in the electronic cash register 20 according to the above described embodiment, the reaction generating mechanism may be omitted. As shown in FIG. 9, a modification of the display unit 24 on the back surface of which the external-force supporting member 62 and the urging member 66 of the reaction generating mechanism are omitted, may be used.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A sales-registration-data processing apparatus comprising:

a housing for accommodating a control unit, the housing having an outer surface in which a recess having a semicircular cross section is provided;

a display unit being independent of said housing and having front and back surfaces, a display portion being provided on the front surface of said display unit, and an expanding portion having a semicircular cross section being provided in the back surface of said display unit, and wherein the expanding portion is arranged in the recess of said housing so as to be movable along a curvature portion of the recess; and a tilt-angle adjustment and maintaining mechanism rotatably connecting said display unit to said housing, capable of tilting said display unit in the recess of said housing from a laid-down position in which the display portion of said display unit is laid down along the outer surface of said housing, to a desired tilt angle of said display unit relative to said housing, and maintaining a desired tilt angle of said display unit, wherein said tilt-angle adjustment and maintaining mechanism includes:

at least one erection guide groove formed in the recess of said housing and having a substantially semicircular-arc shaped vertical cross section extending along the curvature of the recess;

at least one guide projection mounted on the expanding portion of the back surface of said display unit and being slidable along said at least one erection guide groove of said housing; and a frictional-force adjustment mechanism mounted on said at least one guide projection so as to be frictionally engaged with said at least one erection guide groove and capable of adjusting a frictional force generated between said frictional-force adjustment mechanism and said at least one erection guide groove.

2. A sales-registration-data processing apparatus according to claim 1, wherein said frictional-force adjustment mechanism includes:

an elastic member which is in contact with a periphery of said at least one erection guide groove in an inside of said housing; and a contact-pressure adjustment member connecting said elastic member to said guide projection, said contact-pressure adjustment member being capable of adjusting contact pressure of said elastic member with respect to the periphery of said at least one erection guide groove.

3. A sales-registration-data processing apparatus according to claim 1, further comprising a reaction generating mechanism interposed between an outer surface of said display unit and the outer surface of said housing, and maintaining a predetermined tilt angle of said display unit with respect to said housing against an external force acting on said display unit in a direction in which the predetermined tilt angle is reduced while said display unit is maintained at the predetermined tilt angle.

4. A sales-registration-data processing apparatus according to claim 3, wherein said reaction generating mechanism includes:

an external-force supporting member rotatably mounted on the outer surface of said display unit and having a plurality of engagement portions; and an engaged portion mounted on the outer surface of said housing and being engaged with any one of the engagement portions of said external-force supporting member in accordance with a rotational angle of said external-force supporting member with respect to the outer surface of said display unit.

5. A sales-registration-data processing apparatus according to claim 4, wherein said reaction generating mechanism further includes an urging member which urges said external-force supporting member to move said plural engagement portions toward said engaged portion on the outer surface of said housing.

6. A sales-registration-data processing apparatus according to claim 4, wherein:

said external-force supporting member is rotatably mounted on the back surface of said display unit; and a space for accommodating said external-force supporting member is formed between the back surface of said display unit and a region of the outer surface of said housing corresponding to the back surface of said display unit, the space accommodating said external-force supporting member when said display unit is so arranged that said display portion is placed along the outer surface of said housing with said external-force supporting member being arranged along the back surface of said display unit.

7. A sales-registration-data processing apparatus according to claim 6, wherein said reaction generating mechanism further includes an urging member which urges said external-force supporting member to move said plural engagement portions toward said engaged portion on the outer surface of said housing.

8. A sales-registration-data processing apparatus according to claim 1, wherein:

an additional waterdrop-collecting recess is mounted in the first-mentioned recess in the outer surface of said housing so as to be independent of said at least one erection guide groove, along a rotational center line of said display unit and adjacent to said at least one erection guide groove of said tilt-angle adjustment and maintaining mechanism, the additional waterdrop-collecting recess is arranged to collect waterdrops attached to the outer surface of said display unit and which flow down along the tilted outer surface of said display unit during a time that said display unit is tilted with respect to the outer surface of said housing.

9. A sales-registration-data processing apparatus according to claim 8, wherein said additional waterdrop-collecting recess has a waterdrop discharge mechanism which discharges waterdrops collected in said additional waterdrop-collecting recess to an outside of said housing.

* * * * *